US010669865B2

(12) United States Patent
Kirkendall et al.

(10) Patent No.: US 10,669,865 B2
(45) Date of Patent: Jun. 2, 2020

(54) INTERNAL TURBINE COMPONENT ELECTROPLATING

(71) Applicant: Howmet Corporation, Whitehall, MI (US)

(72) Inventors: Willard N. Kirkendall, Muskegon, MI (US); Scott A. Meade, Muskegon, MI (US); Donald R. Clemens, Muskegon, MI (US)

(73) Assignee: HOWMET CORPORATION, Whitehall, MI (US)

( * ) Notice: Subject to any disclaimer, the term of this patent is extended or adjusted under 35 U.S.C. 154(b) by 153 days.

(21) Appl. No.: 15/732,374

(22) Filed: Nov. 1, 2017

(65) Prior Publication Data

US 2018/0073374 A1 Mar. 15, 2018

Related U.S. Application Data

(62) Division of application No. 14/121,919, filed on Nov. 3, 2014, now Pat. No. 9,828,863.

(Continued)

(51) Int. Cl.

| | |
|---|---|
| ***F01D 5/28*** | (2006.01) |
| ***C25D 5/02*** | (2006.01) |
| ***C25D 5/08*** | (2006.01) |
| ***C25D 5/48*** | (2006.01) |
| ***C25D 7/04*** | (2006.01) |
| ***C25D 17/00*** | (2006.01) |
| ***C25D 17/12*** | (2006.01) |
| ***C25D 7/00*** | (2006.01) |
| ***C25D 17/10*** | (2006.01) |

(Continued)

(52) U.S. Cl.

CPC ..... *F01D 5/286* (2013.01); *C25D 5/022* (2013.01); *C25D 5/08* (2013.01); *C25D 5/48* (2013.01); *C25D 7/00* (2013.01); *C25D 7/04* (2013.01); *C25D 17/004* (2013.01); *C25D 17/10* (2013.01); *C25D 17/12* (2013.01); *F01D 5/186* (2013.01); *F01D 9/02* (2013.01); *C25D 3/50* (2013.01); *F05D 2230/31* (2013.01); *F05D 2300/143* (2013.01); *F05D 2300/1431* (2013.01); *F05D 2300/175* (2013.01); *F05D 2300/177* (2013.01)

(58) Field of Classification Search

CPC ..... F01D 5/286; F01D 9/09; C25D 17/12; C25D 17/10; C25D 17/004; C25D 7/00; C25D 7/04; C25D 5/48; C25D 5/08; C25D 5/022; C25D 3/50; F05D 2300/177; F05D 2230/31; F05D 2300/143; F05D 2300/1431; F05D 2300/175

See application file for complete search history.

(56) References Cited

U.S. PATENT DOCUMENTS

| | | | |
|---|---|---|---|
| 2,641,439 A | 6/1953 | Williams | 253/39.15 |
| 3,677,789 A | 7/1972 | Bungardt et al. | 117/22 |

(Continued)

FOREIGN PATENT DOCUMENTS

| | | |
|---|---|---|
| EP | 1 652 965 | 5/2006 |
| EP | 2505692 | 10/2012 |

(Continued)

*Primary Examiner* — Louis J Rufo

(74) *Attorney, Agent, or Firm* — Greenberg Traurig, LLP

(57) ABSTRACT

Method and apparatus are provided for electroplating a surface area of an internal wall defining a cooling cavity present in a gas turbine engine component.

9 Claims, 4 Drawing Sheets

Related U.S. Application Data

(60) Provisional application No. 61/964,006, filed on Dec. 20, 2013.

(51) Int. Cl.

| | |
|---|---|
| ***F01D 5/18*** | (2006.01) |
| ***F01D 9/02*** | (2006.01) |
| ***C25D 3/50*** | (2006.01) |

(56) References Cited

U.S. PATENT DOCUMENTS

| | | | | |
|---|---|---|---|---|
| 4,031,274 | A | 6/1977 | Bessen | |
| 4,323,433 | A | 4/1982 | Loch | 204/279 |
| 4,526,814 | A | 7/1985 | Shankar | 427/253 |
| 5,098,542 | A | 3/1992 | Reinhardt | 204/297.5 |
| 5,102,509 | A | 4/1992 | Albon et al. | 205/257 |
| 5,139,824 | A | 8/1992 | Liburdi | 427/252 |
| 5,261,963 | A | 11/1993 | Basta | 118/724 |
| 5,264,245 | A | 11/1993 | Punola | 427/237 |
| 5,788,823 | A | 8/1998 | Warnes | 205/192 |
| 5,902,471 | A | 5/1999 | Jordan | 205/122 |
| 6,234,752 | B1 | 5/2001 | Wei | 416/96 |
| 6,290,461 | B1 | 9/2001 | Wei | 204/224 M |
| 6,413,584 | B1 | 7/2002 | Wustman | 427/250 |
| 6,502,304 | B2 | 1/2003 | Rigney | 29/889.2 |
| 6,589,668 | B1 | 7/2003 | Braithwaite | 428/610 |
| 6,793,966 | B2 | 9/2004 | Warnes | 427/248.1 |
| 6,929,825 | B2 | 8/2005 | Wustman | 427/250 |
| 7,494,576 | B2 | 2/2009 | Rosenweig | 204/288 |
| 7,501,328 | B2 | 3/2009 | Lockhard | 438/466 |
| 7,560,014 | B2 | 7/2009 | Rucker | 205/96 |
| 7,645,485 | B2 | 1/2010 | Madhava | 427/252 |
| 7,838,070 | B2 | 11/2010 | Gupta | 427/237 |
| 9,840,918 | B2 | 12/2017 | Kirkendall | 427/252 |
| 2004/0018299 | A1 | 1/2004 | Arnold | 427/140 |
| 2006/0042932 | A1 | 3/2006 | Rosenweig | 204/230.2 |
| 2006/0275624 | A1 | 12/2006 | Rucker | 428/689 |
| 2007/0289868 | A1 | 12/2007 | Ellis | 204/280 |
| 2007/0298186 | A1* | 12/2007 | Yang | B21D 51/24 427/438 |
| 2008/0075604 | A1 | 3/2008 | Jabado | 416/241 |
| 2010/0175780 | A1 | 7/2010 | Liu | 141/65 |
| 2012/0222306 | A1 | 9/2012 | Mittendorf | 29/889.1 |
| 2013/0075263 | A1 | 3/2013 | Shawn | 205/81 |

FOREIGN PATENT DOCUMENTS

| | | | | |
|---|---|---|---|---|
| GB | 1 213 821 | | 4/1968 | |
| GB | 2181744 | | 4/1987 | |
| GB | 2181744 A | * | 4/1987 | C25D 7/04 |
| JP | 05-042425 | | 2/1993 | |
| JP | 2001-214704 A | | 8/2001 | |
| JP | 2008-133827 A | | 6/2008 | |

* cited by examiner

INTERNAL TURBINE COMPONENT ELECTROPLATING

RELATED APPLICATION

This application is a division of copending Ser. No. 14/121,919 filed Nov. 3, 2014, which claims benefit and priority of U.S. provisional application Ser. No. 61/964,006 filed Dec. 20, 2013, the entire disclosures of which are incorporated herein by reference.

FIELD OF THE INVENTION

The present invention relates to the electroplating of a surface area of an internal wall defining a cooling cavity present in a gas turbine engine airfoil component in preparation for aluminizing to form a modified diffusion aluminide coating on the plated area.

BACKGROUND OF THE INVENTION

Increased gas turbine engine performance has been achieved through the improvements to the high temperature performance of turbine engine superalloy blades and vanes using cooling schemes and/or protective oxidation/corrosion resistant coatings so as to increase engine operating temperature. The most improvement from external coatings has been through the addition of thermal barrier coatings (TBC) applied to internally cooled turbine components, which typically include a diffusion aluminide coating and/or MCrAlY coating between the TBC and the substrate superalloy.

However, there is a need to improve the oxidation/corrosion resistance of internal surfaces forming cooling passages or cavities in the turbine engine blade and vane for use in high performance gas turbine engines.

SUMMARY OF THE INVENTION

The present invention provides a method and apparatus for electroplating of a surface area of an internal wall defining a cooling passage or cavity present in a gas turbine engine component to deposit a noble metal, such as Pt, Pd, etc. that will become incorporated in a subsequently formed diffusion aluminide coating formed on the surface area in an amount of enrichment to improve the protective properties thereof.

In an illustrative embodiment of the invention, a method involves positioning an electroplating mask on a region of the component, such as a shroud region of a vane segment, where the cooling cavity has an open end to the exterior, extending an anode through the mask and cavity opening into the cooling cavity, extending a cathode through the mask to contact the component, and extending an electroplating solution supply conduit through the mask to supply electroplating solution to the cavity opening for flow into the cooling cavity during at least part of the electroplating time. The anode can be supported on an electrical insulating anode support. The anode and the anode support are adapted to be positioned in the cooling cavity when the turbine component is positioned on electroplating tooling. The anode support can be configured to function as a mask so that only certain wall surface area(s) is/are electroplated, while other wall surface areas are left un-plated as a result of masking effect of the anode support. The electroplating solution can contain a noble metal including, but not limited to, Pt, Pd, Au, and Ag in order to deposit a noble metal layer on the selected surface area. When first and second cooling cavities are to be electroplated, a first and second anode and respective first and second electroplating solution supply conduit are provided through an electroplating mask for each respective first and second cooling cavity.

Following electroplating, a diffusion aluminide coating is formed on the plated internal surface area by gas phase aluminizing (e.g. CVD, above-the-pack, etc.), pack aluminizing, or any suitable aluminizing method so that the diffusion aluminide coating is modified to include an amount of noble metal enrichment to improve its high temperature performance.

The airfoil component can have one or multiple cooling cavities that are electroplated and then aluminized. For example, certain gas turbine engine vane segments have multiple cooling cavities such that the invention provides an elongated anode and an associated electroplating solution supply conduit for electroplating each cooling cavity.

These and other advantages of the invention will become more apparent from the following drawings taken with the detailed description.

DETAILED DESCRIPTION OF THE INVENTION

Figure 1:
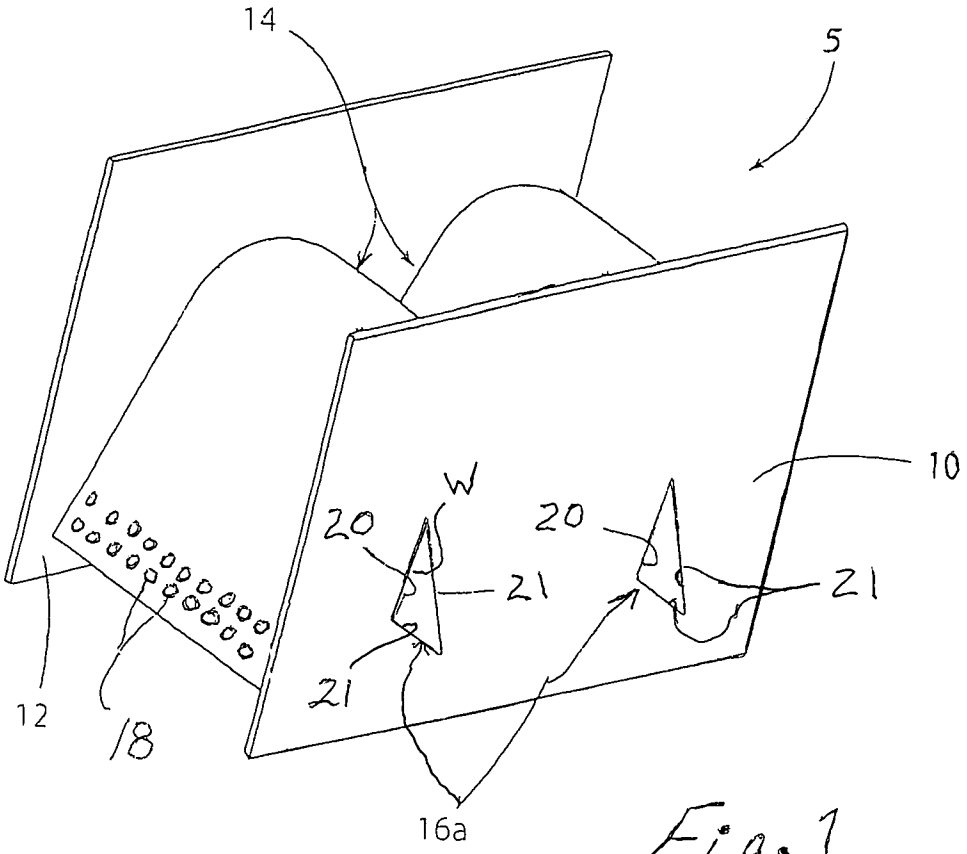
FIG. 1 is a schematic perspective view of a gas turbine engine vane segment having multiple (two) internal cooling cavities to be protectively coated at certain surface areas.

The invention provides a method and apparatus for electroplating a surface area of an internal wall defining a cooling cavity present in a gas turbine engine airfoil component, such as a turbine blade or vane, or segments thereof. A noble metal, such as Pt, Pd, etc. is deposited on the surface area and will become incorporated in a subsequently formed diffusion aluminide coating formed on the surface area in an amount of noble metal enrichment to improve the protective properties of the noble metal-modified diffusion aluminide coating.

For purposes of illustration and not limitation, the invention will be described in detail below with respect to electroplating a selected surface area of an internal wall defining a cooling cavity present in a gas turbine engine vane segment 5 of the general type shown in FIG. 1 wherein the vane segment 5 includes first and second enlarged shroud regions 10, 12 and airfoil-shaped region 14 between the shroud regions 10, 12. Airfoil-shaped region 14 includes multiple (two shown) internal cooling passages or cavities 16 that each have an open end 16*a* to the exterior to receive cooling air and that extends longitudinally from shroud region 10 toward shroud region 12 inside the airfoil-shaped region. The cooling air cavities 16 each have a closed internal end remote from open ends 16*a* and are communicated to cooling air exit passages 18 extending laterally from the cooling cavity 16 to an external surface of the airfoil region, such as trailing edge surface areas, where cooling air exits from passages 18. The cooling air exit passages are located on respective trailing airfoil edge surface areas such that the cooling air cavities 16 are termed trailing edge cooling air cavities. The vane segment 5 can be made of a conventional nickel base superalloy, cobalt base superalloy, or other suitable metal or alloy for a particular gas turbine application.

In one application, a selected surface area 20 of the internal wall W defining each cooling cavity 16 is to be coated with a protective noble metal-modified diffusion aluminide coating, FIG. 1. Other generally flat surface areas 21 and closed-end area of the internal wall W are left uncoated when coating is not required there and to save on noble metal costs. For purposes of illustration and not limitation, the invention will be described below in connection with a Pt-enriched diffusion aluminide, although other noble metals can be used to enrich the diffusion aluminide coating, such other noble metals including, but not being limited to, Pd, Au, and Ag.

Figure 2:
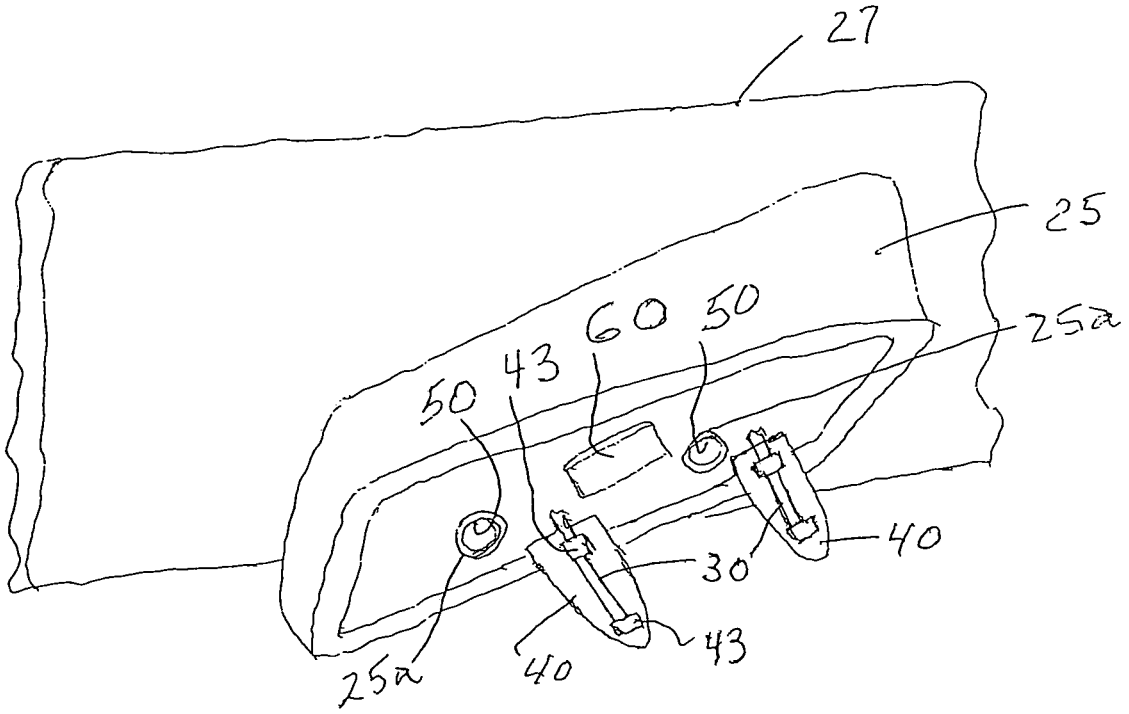
FIG. 2 is a partial perspective view of tooling showing an electroplating mask disposed on a shroud region of a vane segment, the tooling having first and second anodes on respective anode supports extending exteriorly from an inner side of the mask to enter respective first and second cooling cavities, having a cathode extending through the mask to contact the shroud region, and also having first and second electroplating solution supply passages associated with the first and second anodes and extending through the mask to the cavity openings for supplying electroplating solution to the respective first and second cooling cavities.
Figure 2A:
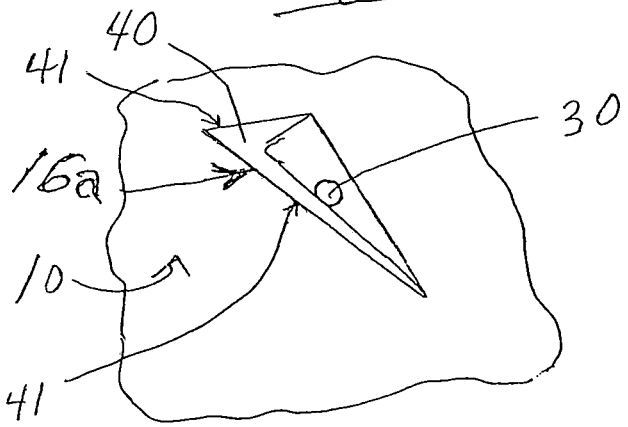
FIG. 2A is a side view of one anode-on-support in one of the cooling cavities.
Figure 3:
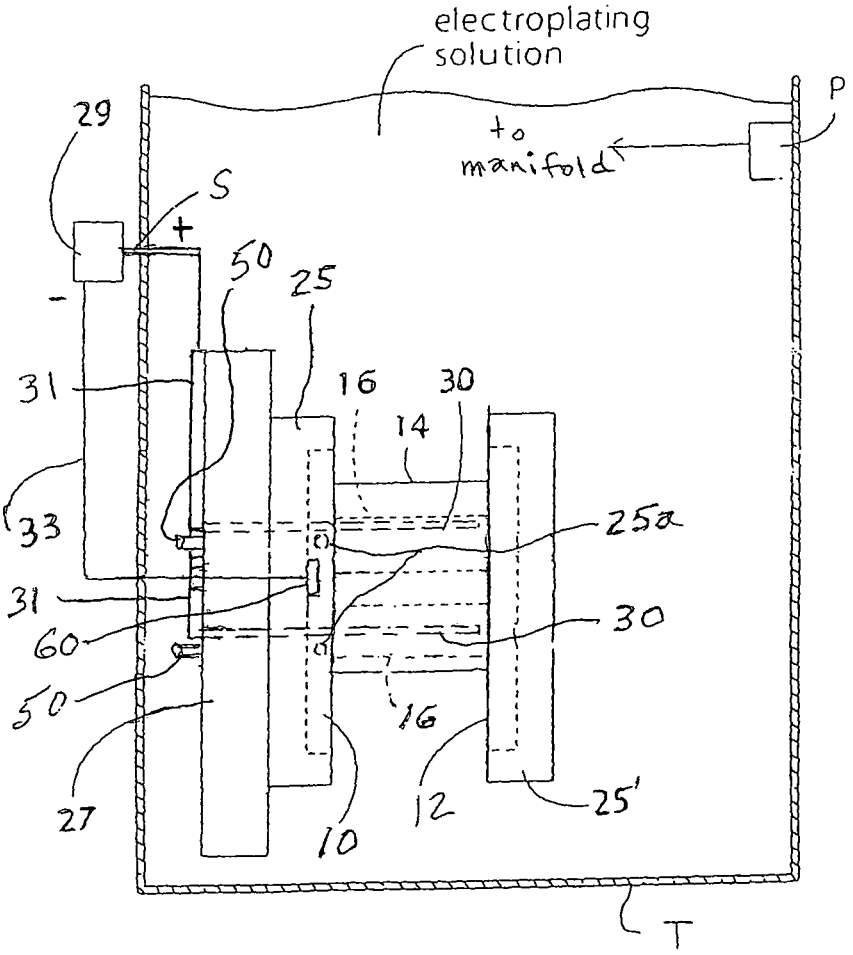
FIG. 3 is a side view of the vane segment held in electrical current-supply tooling in the electroplating tank and showing the anodes connected to a bus bar to receive electrical current from a power source and showing electroplating solution supply tubing for receiving electroplating solution from the pump in the tank.
Figure 4:
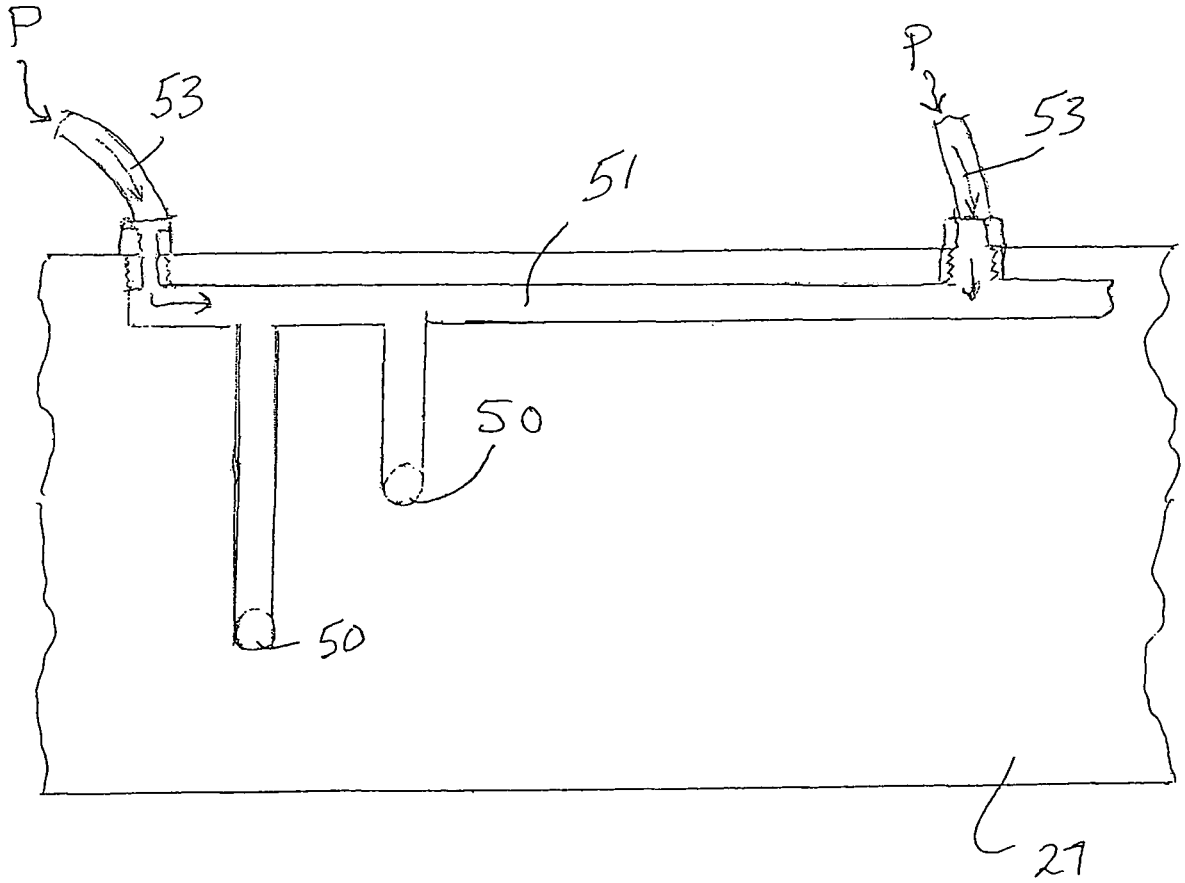
FIG. 4 is a view of the electroplating solution supply manifold that is connected by tubing to the pump wherein the manifold also has first and second supply tubes extending through the electroplating mask for supplying the electroplating solution to the respective first and second cooling cavities.

Referring to FIGS. 2-4, a vane segment 5 is shown having a water-tight, flexible mask 25 fitted to the shroud region 10 to prevent plating of that masked shroud area 10 where the cavity 16 has open end 16*a* to the exterior. The mask 25 is attached on the fixture or tooling 27. The other shroud region 12 is covered by a similar mask 25' to this same end. The masks can be made of Hypalon® material, rubber or other suitable material. The mask 25 includes first and second through-openings 25*a*, each of which receives a respective first and second supply tubing conduit 50 through which the noble metal-containing electroplating solution is flowed directly into each cooling cavity 16. To this end, electroplating solution supply tubing conduit 50 is received in respective mask through-passages that terminate in openings 25*a* with the ends of the tubing 50 directly facing and generally aligned with the cooling cavity entrance openings 16*a*. Each supply tubing conduit 50 is thereby communicated directly to a respective cooling cavity 16 to provide electroplating solution flow directly into that cooling cavity 16, FIG. 3. Each supply tubing conduit 50 extends through the mask to connect to a supply manifold 51, FIG. 4, which can be disposed at any suitable location. The manifold 51 includes one or more supply tubing conduits 53 that, in turn, is/are communicated and connected to tank-mounted pump P. The ends of the supply tubing 50 sans manifold 51 are shown in FIG. 3 for convenience. Two supply tubes 53 are shown in FIG. 4 since another electroplating station similar to that shown is disposed to the right in the figure in order to electroplate a second vane segment 5.

The invention envisions in an alternative embodiment to sealably attach the electroplating solution tubing conduit 50 to the outer side of the mask 25, rather than to extend all the way through it to the inner mask side as shown. The mask then can include electroplating solution supply passages (as one or more electroplating solution supply conduits) that extend from the tubing fastened at the outer mask side through the mask to the inner mask side thereof to provide electroplating solution to the cavity open ends 16*a*.

Electroplating solution is supplied to each supply tubing conduit 50 and its associated cooling cavity 16 during at least part of the electroplating time, either continuously or periodically or otherwise, to replenish the Pt-containing solution in the cavities 16. For purposes of illustration and not limitation, a typical flow rate of the electroplating solution can be 15 gallons per minute or any other suitable flow rate. Two supply tubes 53 are shown in FIG. 4 since another electroplating station similar to that shown is disposed to the left in order to electroplate a second vane segment 5.

Electroplating takes place in a tank T containing the electroplating solution with the vane segment 5 held submerged in the electroplating solution on electrical current-supply tooling 27, FIG. 3. The fixture or tooling 27 as well as supply tubing conduits 50, 53 can be made of polypropylene or other electrical insulating material. The elongated anodes 30 extends through the mask 25 and receives electrical current via electrical current supply bus 31, which can be located in any suitable location on the tooling 27, and is connected to electrical power supply 29. The vane segment 5 is made the cathode of the electrolytic cell by an electrical cathode bus 33 that extends through the mask 25 to contact the shroud region 10. In particular, the cathode bus terminates in a cathode contact pad 60 on the inner side of the mask 25, FIG. 2, and contacts the shroud region 10 when the vane segment 5 is placed onto the tooling 27, while the first and second anodes 30 on their respective supports 40 enter the respective first and second cooling cavities 16 as the vane segment 5 is placed on the tooling. The cathode bus is sandwiched between electrical insulating sheets, such as polypropylene sheets.

All seams and joints of the above-described tooling and tooling components are water-tight sealed using a thermoplastic welder, sealing material or other suitable means.

The first and second elongated anodes 30 extend from the anode bus 31 through the mask 25 and into each respective first and second cooling cavity 16 along its length but short of its dead (closed) end. Each anode 30 is shown as a cylindrical, rod-shaped anode, although other anode shapes can be employed in practice of the invention. Each anode 30 is shown residing on an electrical insulating anode support 40 exterior of the inner mask side, FIG. 2, which can made of machined polypropylene or other suitable electrical insulating material. The supports 40 have masking surfaces 41 that shield the cavity wall surfaces 21 that are not to be coated so that they are not electroplated. Each anode 30 can be located on support 40 by one or more upstanding anode locator ribs 43 that are integral to supports 40.

The anode 30 and the support 40 collectively have a configuration and dimensions generally complementary to that of each cooling cavity 16 that enable the assembly of anode and support to be positioned in the cooling cavity 16 spaced from (out of contact with) the internal wall surface area 20 to be electroplated and shielding or masking wall surface areas 21 so that only surface area 20 is electroplated. Surface areas 21 are left un-plated as a result of masking effect of surfaces 41 of the anode support 40. Such surface areas 21 are left uncoated when coating is not required there for the intended service application and to save on noble metal costs.

When electroplating a vane segment made of a nickel base superalloy, the anode can comprises conventional Nickel 200 metal, although other suitable anode materials can be used including, but not limited to, platinum-plated titanium, platinum-clad titanium, graphite, iridium oxide coated anode material and others.

The electroplating solution in the tank T comprises any suitable noble metal-containing electroplating solution for depositing a layer of noble metal layer on surface area 20. Typically, the electroplating solution can comprise an aqueous Pt-containing KOH solution of the type described in U.S. Pat. No. 5,788,823 having 9.5 to 12 grams/liter Pt by weight (or other amount of Pt), the disclosure of which is incorporated herein by reference, although the invention can be practiced using any suitable noble metal-containing electroplating solution including, but not limited to, hexachloroplatinic acid ($H_2PtCl_6$) as a source of Pt in a phosphate buffer solution (U.S. Pat. No. 3,677,789), an acid chloride solution, sulfate solution using a Pt salt precursor such as $[(NH_3)_2Pt(NO_2)_2]$ or $H_2Pt(NO_2)_2SO_4$, and a platinum Q salt bath ($[(NH_3)_4Pt(HPO_4)]$ described in U.S. Pat. No. 5,102,509).

Each anode 30 is connected by electrical current supply bus 31 to conventional power source 29 to provide electrical current (amperage) or voltage for the electroplating operation, while the electroplating solution is continuously or periodically or otherwise pumped into the cooling cavities 16 to replenish the Pt available for electroplating and deposit a Pt layer having uniform thickness on the selected surface area 20 of the internal wall of the cooling cavity 16, while masking wall surface areas 21 from being electroplated. The electroplating solution can flow through the cavities 16 and exit out of the cooling air exit passages 18 into the tank. The vane segment 5 is made the cathode by electrical cathode bus 33 and contact pad 60. For purposes of illustration and not limitation, the Pt layer is deposited to provide a 0.25 mil to 0.35 mil thickness of Pt on the selected surface area 20, although the thickness is not so limited and can be chosen to suit any particular coating application. Also for purposes of illustration and not limitation, an electroplating current of from 0.010 to 0.020 amp/cm$^2$ can be used to deposit Pt of such thickness using the Pt-containing KOH electroplating solution described in U.S. Pat. No. 5,788,823.

During electroplating of the cooling cavities 16, the external surfaces of the vane segment 5 (between the masked shroud regions 10, 12) optionally can be electroplated with the noble metal (e.g. Pt) as well using another anode (not shown) disposed on the tooling 27 external of the vane segment 5 and connected to anode bus 31, or the external surfaces of the vane segment can be masked completely or partially to prevent any electrodeposition thereon.

Following electroplating and removal of the anode and its anode support from the vane segment, a diffusion aluminide coating is formed on the plated internal wall surface areas 20 and the unplated internal wall surface areas by conventional gas phase aluminizing (e.g. CVD, above-the-pack, etc.), pack aluminizing, or any suitable aluminizing method. The diffusion aluminide coating formed on surface areas 20 includes an amount of the noble metal (e.g. Pt) enrichment to improve its high temperature performance. That is, the diffusion aluminide coating will be enriched in Pt to provide a Pt-modified diffusion aluminide coating at each surface area 20 where the Pt layer formerly resided as a result of the presence of the Pt electroplated layer, which is incorporated into the diffusion aluminide as it is grown on the vane segment substrate to form a Pt-modified NiAl coating. The diffusion coating formed on the other unplated surface areas 21, etc. would not include the noble metal. The diffusion aluminide coating can be formed by low activity CVD (chemical vapor deposition) aluminizing at 1975 degrees F. substrate temperature for 9 hours using aluminum chloride-containing coating gas from external generator(s) as described in U.S. Pat. Nos. 5,261,963 and 5,264,245, the disclosures of both of which are incorporated herein by reference. Also, CVD aluminizing can be conducted as described in U.S. Pat. Nos. 5,788,823 and 6,793,966, the disclosures of both of which are incorporated herein by reference.

Although the present invention has been described with respect to certain illustrative embodiments, those skilled in the art will appreciate that modifications and changes can be made therein within the scope of the invention as set forth in the appended claims.

The invention claimed is:

1. Apparatus for electroplating a surface area of an internal wall defining a cooling cavity present in a gas turbine engine component having a first end region with an opening into the cooling cavity and a second end region that is closed, comprising:

a first electrically insulating mask configured for fitting on the first end region of the component where the cooling cavity has a cavity open end to the exterior;

an anode extending through the first mask and the opening into the cooling cavity, the first mask supporting the anode in electrically insulated relationship to the component with the anode extending into the cooling cavity;

a second electrically insulating mask configured for fitting on the second end region exterior to the cooling cavity;

a cathode extending through the first mask to contact the component; and an electroplating solution supply conduit or passage extending through the first mask adapted to supply electroplating solution to the cooling cavity.

2. The apparatus of claim 1 including a pump flowing a noble-metal containing electroplating solution to the supply conduit or passage and into the cooling cavity.

3. The apparatus of claim 1 wherein the solution includes at least one selected from the group of Pt and Pd to deposit at least one selected from the group of a Pt layer and Pd layer on the surf ace area.

4. The apparatus of claim 1 wherein the anode comprises nickel and the component is made of Ni base superalloy.

5. The apparatus of claim 1 wherein the component comprises a gas turbine engine vane or blade or segment thereof.

6. The apparatus of claim 1 wherein the anode resides on an anode support exterior of the mask so that the anode on the support is positioned in the cooling cavity when the component is disposed on the mask.

7. The apparatus of claim 1 including a tank having the electroplating solution therein and in which the component with the anode therein is submerged.

8. The apparatus of claim 1 wherein the mask comprises rubber.

9. The apparatus of claim 1 wherein the mask comprises a flexible material.

* * * * *